United States Patent [19]

Anders

[11] Patent Number: 4,608,781

[45] Date of Patent: Sep. 2, 1986

[54] SEPARATING DEVICE FOR DOOR CASES ON FLOORS WITH DIFFERENT HEIGHTS

[76] Inventor: Peter Anders, Ahornallee 47, 1000 Berlin 19, Fed. Rep. of Germany

[21] Appl. No.: 619,463

[22] PCT Filed: Oct. 5, 1983

[86] PCT No.: PCT/DE83/00170

§ 371 Date: Jun. 8, 1984

§ 102(e) Date: Jun. 8, 1984

[87] PCT Pub. No.: WO84/01598

PCT Pub. Date: Apr. 26, 1984

[30] Foreign Application Priority Data

Oct. 8, 1982 [DE] Fed. Rep. of Germany ..... 3237348

[51] Int. Cl.[4] ..... E06B 1/70

[52] U.S. Cl. ..... 49/468; 52/204; 49/505

[58] Field of Search ..... 49/468, 469, 467, 505; 52/204, 126.2, 126.3

[56] References Cited

U.S. PATENT DOCUMENTS

| | | | |
|---|---|---|---|
| 2,837,786 | 6/1958 | Fryar, Jr. | 49/468 |
| 3,778,931 | 12/1973 | Donaldson | 49/469 X |
| 3,967,412 | 7/1976 | Governale | 49/468 |
| 4,156,325 | 5/1979 | McMullen et al. . | |
| 4,213,275 | 7/1980 | Oehmig | 49/468 |
| 4,224,766 | 9/1980 | Procton | 49/468 |
| 4,287,684 | 9/1981 | McKann | 49/468 |

FOREIGN PATENT DOCUMENTS

| | | |
|---|---|---|
| 1609913 | 4/1970 | Fed. Rep. of Germany . |
| 2162244 | 6/1973 | Fed. Rep. of Germany . |
| 2256098 | 5/1974 | Fed. Rep. of Germany . |
| 2537899 | 3/1976 | Fed. Rep. of Germany . |
| 2716497 | 10/1978 | Fed. Rep. of Germany . |
| 2153809 | 5/1973 | France . |
| 2490269 | 3/1982 | France . |

*Primary Examiner*—Philip C. Kannan

*Attorney, Agent, or Firm*—Wenderoth, Lind & Ponack

[57] ABSTRACT

The invention relates to a separating device for door cases on floors with different heights, which is used to inject a moisture-proof seal, for example, and which can be anchored in the jointless floor and can be secured to the door cases with a bottom part which has an expansion element. A height-adjustable, connectable top part can be reverse-drawn over the bottom part, the upper surface of the top part being aligned with the upper surface of the higher floor. An adjustable clamping device is used to spread the expansion element of the bottom part relative to the top part, the sealing device being clamped between the bottom part and the top part. The separating device is easy to install and can be flexibly adjusted to various height differences between floors with different heights.

16 Claims, 6 Drawing Figures

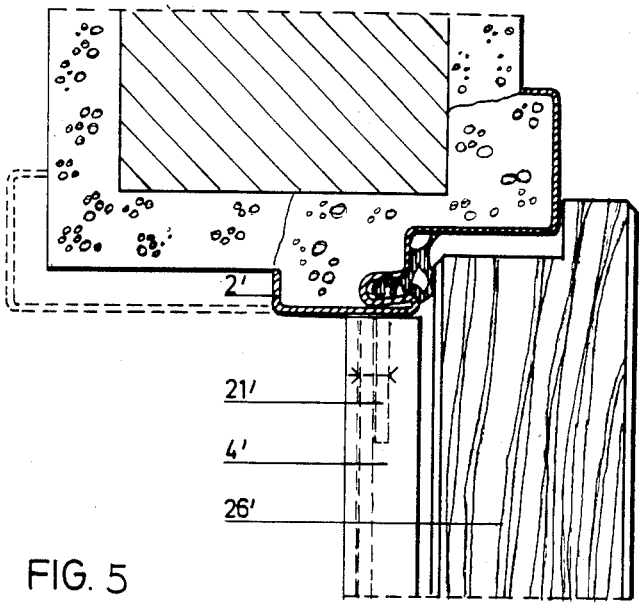
FIG. 5
FIG. 4
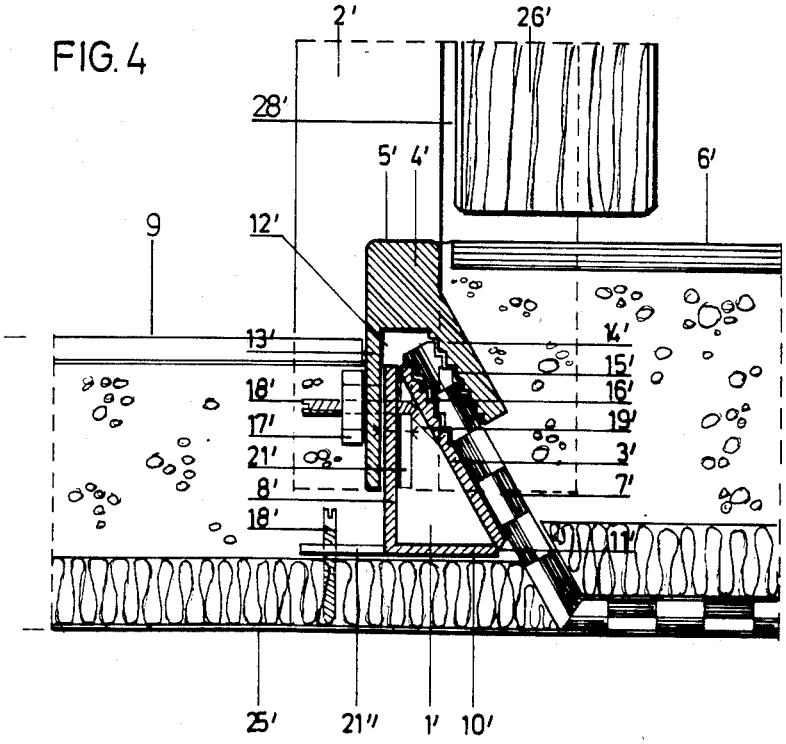

SEPARATING DEVICE FOR DOOR CASES ON FLOORS WITH DIFFERENT HEIGHTS

The invention relates to a separating device for door cases on floors with different heights, that is, at different levels.

It is common practice to employ the following prior art devices as a separating rail for floors with different heights.

The simplest device in use is a metal strip rail placed edgewise across the door case and cast into the jointless floor. A particular disadvantage of this device is its complete instability, since it cannot be secured exactly on the separating line provided.

A somewhat more stable device is a doorsill that has exactly the shape of the steel sheet door cases of known construction and which is welded horizontally thereacross. The particular drawback of this device lies in the fact that the welding-in by the workmen, in particular tile setters or jointless-floor layers, who actually would have to perform this task during the work cycle, cannot be accomplished with skill. Thus, a welder must be called in.

Another disadvantage common to all prior art devices is that the injection of the moistureproof seal in compliance with DIN regulations is not possible in doors leading to wet rooms.

Therefore, the major object of the invention is to provide a separating device for door cases on floors with different heights in such a way that, particularly if the required moistureproof seal for wet rooms is properly clamped into position, it can be flexibly adapted to height differences between floors at different levels and which is easy to install.

The separating device of the invention enables the proper injection of the moistureproof seal of wet rooms.

The bottom rail member of the separating device has a longer leg with oval, vertical holes therein and screw bolts attached to straps on a door case pass through these holes to secure the bottom rail member to the door case. The top rail member of the separating device has a downwardly extending portion with U-shaped recesses and headless screw bolts pass through threaded holes in the longer leg of the bottom rail member, so that the top part of the separating device can be secured at various heights.

The separating device can be variably installed in a horizontal direction both by the bottom rail member secured to the straps on a door case by means of its oval, vertical holes and the screw bolts, and by the top rail member with its U-shaped recesses and the headless screw bolts passed therethrough, since the oval, vertical holes in the bottom rail member are wider than the diameter of the headless screw bolts, and since the U-shaped recesses are wider than the diameter of the headless screw bolts. As a result, mounting tolerances of the door frame can be compensated.

Another advantage is that, when installing the bottom rail member across the door case, the latter is prevented from being pressed and driven downward until the jointless floor is set onto the unfinished floor, and that on the lower end of the longer leg of the bottom rail member in the direction of the lower floor, straps are provided having threaded holes through which screw bolts are passed until their pointed ends reach the unfinished floor.

Prior to the setting of the jointless floor onto the unfinished floor, these screw bolts must be tightened again to prevent the formation of noise bridges to the unfinished floor. As a result, the bottom ends of the door cases remain perfectly aligned until the jointless floor is installed.

Furthermore, in the top rail member, in the side pointing toward the door leaf, a rearwardly flaring groove may be provided into which a commercially available elastic sealing strip can be inserted to withstand exposure to noise and air.

The separating device can also be used as a separating rail between floors with different heights, none of which is the floor of a wet room, so that no moistureproof seal is present, preferably between the normally higher staircase floor and the lower floor adjacent thereto. In this case, instead of the moistureproof seal an equally thick buffer strip is interposed between the top and the bottom rail members and which, by simultaneously tightening the headless screw bolts and the nuts thereon, is compressed in such a way that top and bottom rail members are rigidly secured to one another.

In this case, the device is used as the lower stop for the door leaf and as a separating rail between the two floors mentioned above.

The top rail member can be made of plastic or metal.

The separating device incorporating the invention can also be used for door cases in which the door leaf opens into the room with the higher floor. In this case, the top of the top rail member preferably has a narrower shape, as depicted in FIG. 4.

Since in all embodiments the straps are always mounted at the same site on the lower end of the door cases, mass production is facilitated.

The bottom rail member can be mounted in quantity in all door cases, but the top part only if required in the presence of floors with different heights. In this way, there is a clear separation of the jointless floor between the different rooms and, as a result, jagging-out of the jointless floor otherwise necessitated in prior art door cases, can be dispensed with.

The separating device embodying the invention can be mounted not only across steel door frames, but also across door cases of wood or plastic, for example. In this case, one must install at the bottom and on both sides of the wood or plastic door case a strap onto which the bottom rail member is screwed in the manner described above.

The separating device can be fabricated in various lengths and adapted to door cases with different widths. It can also be used in floor superstructures that are higher than the customary 6.0 cm in housing construction. In this case, the bottom rail member must be made with different heights.

The separating device can also be employed for vertical height differences between adjacent floors, due to floors of different thicknesses with heights greater than the customary 2.0 cm or less in housing construction. In this case, the top rail member must be made with different heights and its upper end extended.

The separating device can also be utilized both in corner and in exterior door cases.

The device taught by the invention will now be described in greater detail with reference to the accompanying drawings in which:

FIG. 4 is a vertical section through the device of the invention as claimed in Subclaim 3. In this case, the door leaf opens into the wet room or into the room with the higher floor;

FIG. 5 is a horizontal section through the door case with a top view of the device of the invention in the modification depicted in FIG. 4;

Figure 2:
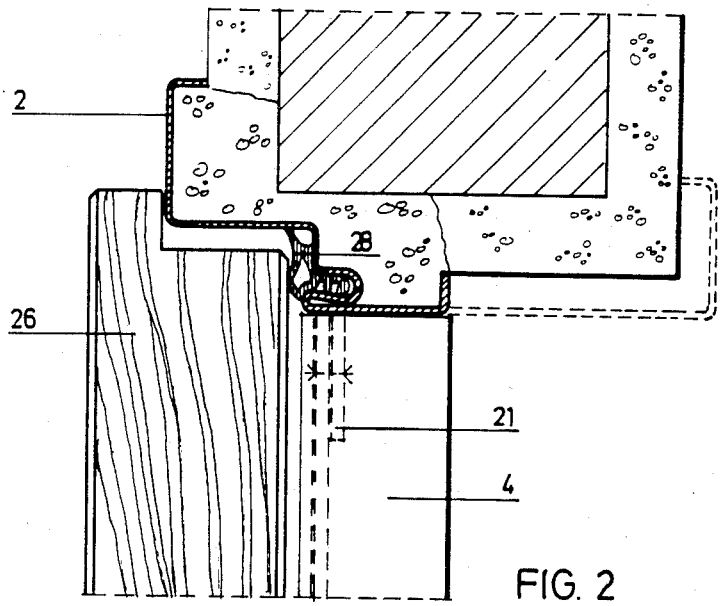
FIG. 2 is a horizontal section through the door case with a top view of the device of the invention.
Figure 1:
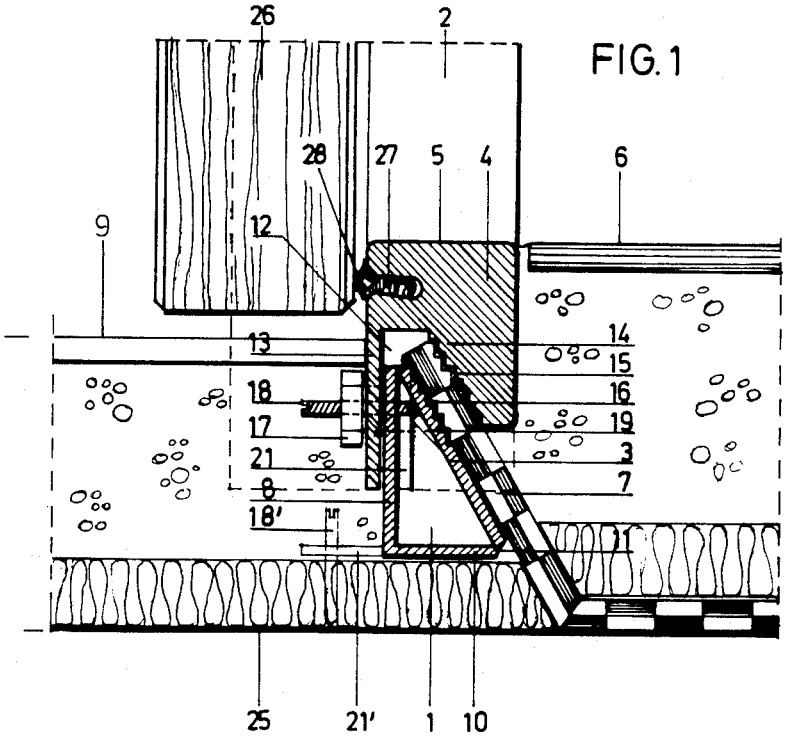
FIG. 1 is a vertical section through the device of the invention.
Figure 3:
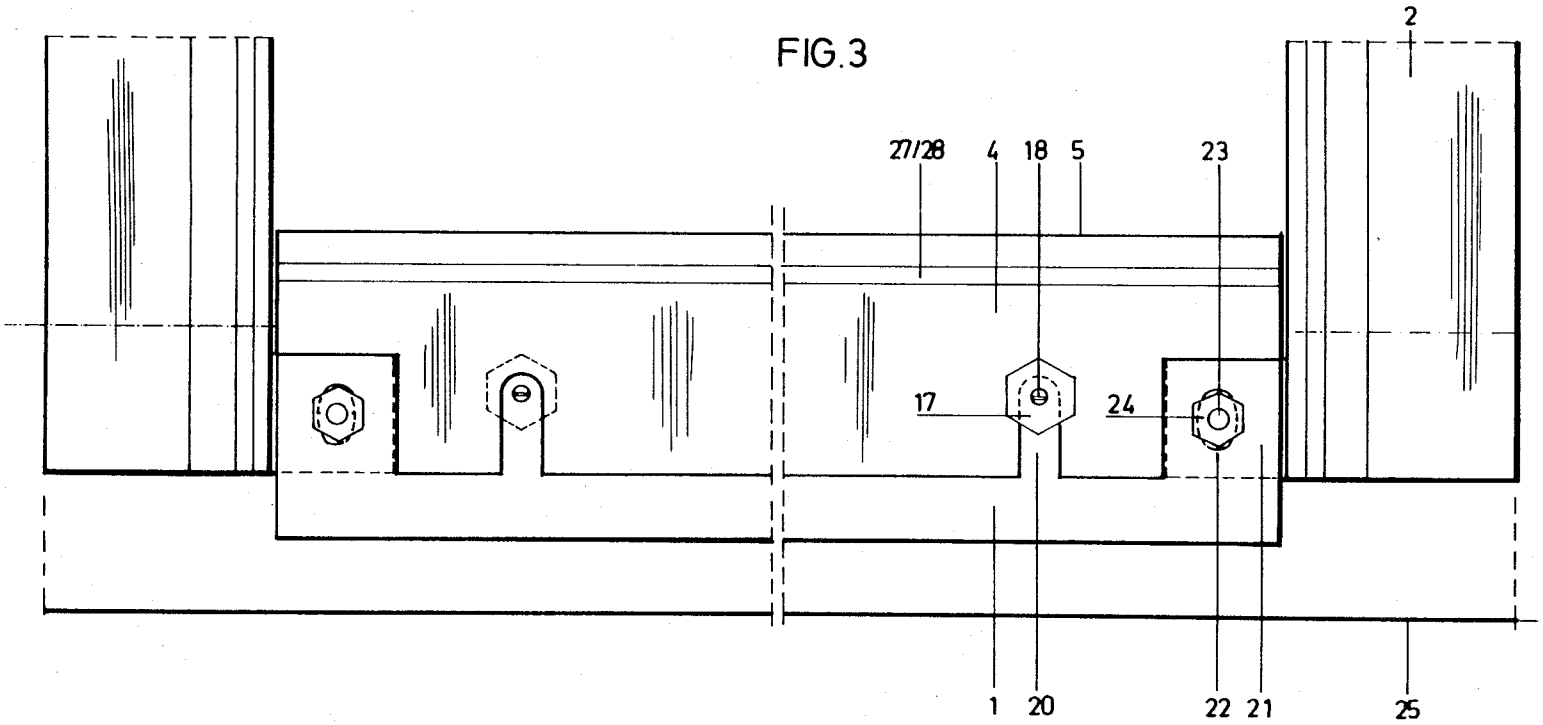
FIG. 3 is a front view from the side of the headless screw bolts towards the device of the invention.
Figure 6:
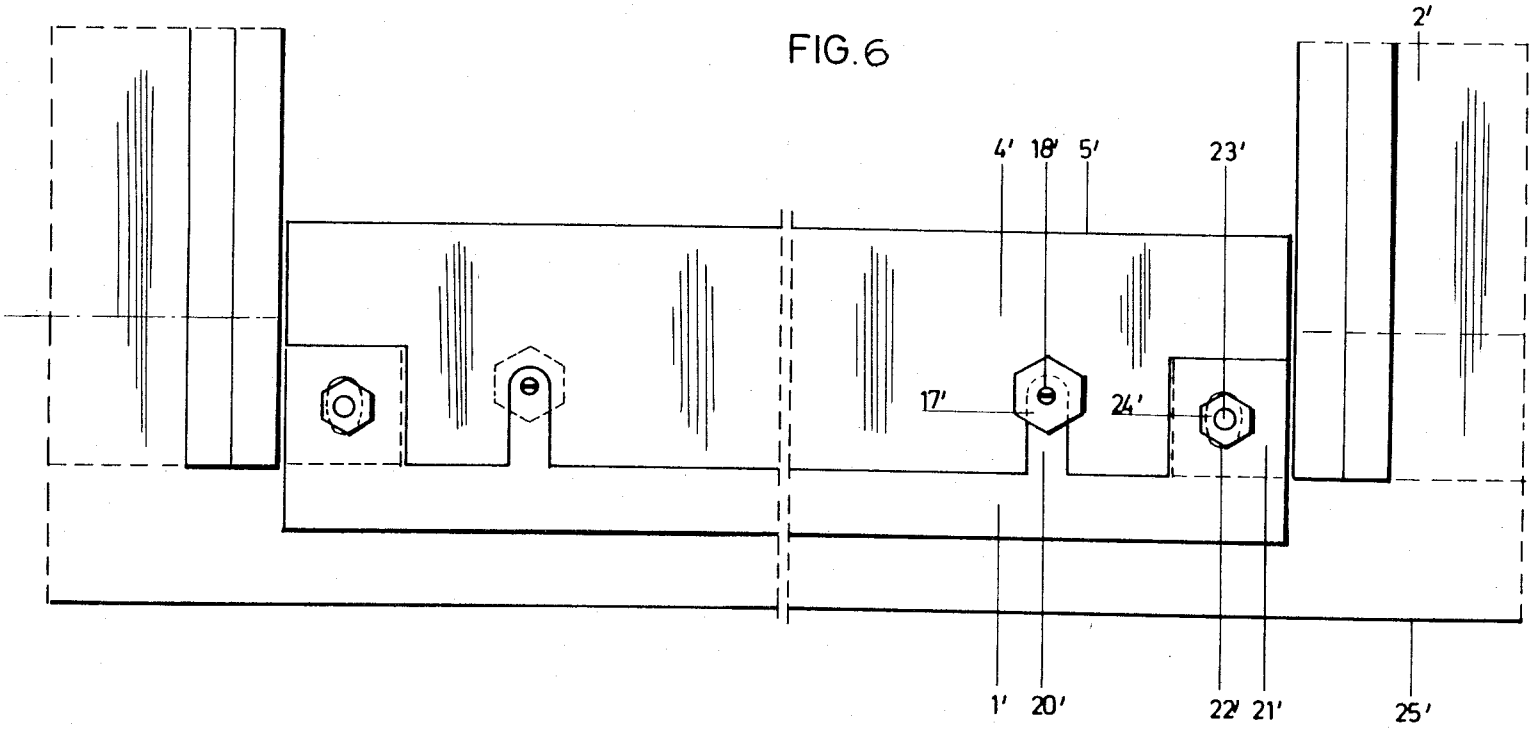
FIG. 6 is a front view from the side of the headless screw bolts towards the device of the invention in the modification illustrated in FIG. 4.

FIG. 1 shows the vertical section through a preferred embodiment of the device incorporating the invention, in which the bottom rail member 1 is secured to both straps of the door case 2 by screw bolts 23 and nuts 24, the longer leg 8 of the bottom part 1 having right and left an oval, vertical hole 22 whose center is at the site where a screw bolt 23 is secured to each of the straps 21 (FIG. 3) The nuts 24 to be screwed onto the screw bolts 23 have a larger diameter than the oval, vertical holes 22. As a result, mounting tolerances of the door cases 2 can be compensated in longitudinal direction, and the entire separating device can be adjusted upwards with respect to the height of the higher floor 6.

The bottom rail member 1 has a triangular cross-sectional shape of an angle of a rectangular, non-isosceles triangle whose longer leg 8 is perpendicular to the surface of the lower floor 9, the right angle of the triangle being located on the lower end of the vertical longer leg 8. The horizontal, shorter leg 10 of the triangle faces the direction of the higher floor 6 and the hypotenuse is formed by a movable metal spreader rail 3 which forms an angle with lower leg 10 and whose lower end is fastened to the end of the shorter leg 10 to form a swivel hinge 11 for the expansion motion relative to the top rail member 4. Preferably, this fastening is accomplished by loose spot welding or by a hinge-type construction.

A moistureproof seal 7 is placed on the metal strip rail 3 if the separating device is employed in doors leading to wet rooms, and a buffer strip 7' is installed if it is used in doors between floors with different heights, neither of which is the floor of a wet room, so that there is no moistureproof seal 7.

The top rail member 4 is reverse-drawn onto the bottom rail member 1 with the moistureproof seal 7 or with a buffer-strip 7' put on. The top rail member 4 has a recess 12 which opens to its bottom part in such a way that, when the top rail member 4 is reverse-drawn onto the bottom rail member 1, a downwardly extending attachment portion 13 delimiting the recess 12 of the top rail member 4 is flush with the outer surface of the longer leg 8 of the bottom rail member 1, and that the surface of a downwardly extending clamping portion 14 of the top rail member 4 facing the downwardly extending attachment portion 13 and delimiting the recess 12 is parallel to, that is has a slope corresponding to the slope of movable metal spreader rail 3 in non-expanded condition, as well as a toothed profiling 15 which coacts with a toothed profiling 16 on the movable outer surface of the metal spreader rail 3, during the latter's expansion motion brought about by the clamping device, to clamp the moistureproof seal 7 into position. The clamping device is formed by the headless screw bolts 18 and the associated nuts 17.

The moistureproof seal 7 or the buffer strip 7'(FIG. 4) is clamped by tightening the headless screw bolts 18 that pass through the longer leg 8 of the bottom rail member 1 into threaded holes, so that the movable metal spreader rail 3, by tightening the headless screw bolts (18) of the bottom rail member 1, is pressed against the portion 14 of the top rail member 4 delimiting the recess 12, while at the same time the nuts 17 on the headless screw bolt 18 are tightened.

The pointed ends of the headless screw bolts 18, which pass through threaded holes of the longer leg 8 of the bottom rail member 1, are driven toward the movable metal spreader rail 3 during the tightening and engage slip-free tongues 19.

The vertically adjustable top rail member 4 is adjusted to the height of the higher floor 6 by tightening the nuts 17 on the headless screw bolts 18, the portion 13 of the top rail member 4, which is flush with the outer surface of the longer leg 8 of the bottom rail member 1, having U-shaped recesses 20 (FIG. 3) through which penetrate the headless screw bolts 18 with a diameter which is smaller than the width of the U-shaped recesses 20. As a result, dimensional tolerances both in the horizontal and in the vertical line, and height differences between floors with different heights can be compensated.

To prevent the bottom rail member 1, after being secured to the door case 2, from being pressed or driven downward and thereby to prevent the warping of the installed door frame 2, spaced-apart, horizontal straps 21' may be mounted on the lower end of the longer leg 8 in the extension of the shorter leg 10 of the bottom rail member 1 in the direction of the lower floor 9 at distances approximately one-third of the overall width of the door. Screw bolts 18' are driven through the threaded holes provided in the straps 21' until their pointed ends reach the unfinished floor 25.

Prior to the setting of the jointless floor onto the unfinished floor, these screw bolts 18' must be tightened again in order to prevent the formation of noise bridges to the unfinished floor 25.

The top rail member 4 has on its side pointing to the door leaf 26 a rearwardly flaring groove 27 into which can be inserted an elastic, commercially available gasket 28 to provide a noise and air seal.

The headless screw bolts 18 which pass through the threaded holes of the longer leg 8 of the bottom rail member 1 are spaced from each other a distance of approximately 15 cm in the top part of the longer leg 8.

Preferably, the top rail member 4 can be made of metal or plastic.

FIG. 4 shows a modified embodiment of the separating device depicted in FIG. 1 for use in door cases in which the door leaf 26' opens into the room with the higher floor 6'.

In this case, the top rail member 4' preferably has a narrower profiling at the top, the narrowed portion being provided above the portion 14' delimiting the recess 12', so that the outer edge of the top rail member 4' facing the portion 13' delimiting the recess 12' terminates flush with the door case edge into which the commercially available, elastic gasket 28' is inserted.

I claim:

1. A separating device for door cases between adjacent floors having different heights, comprising:

bottom rail member means adapted for attachment to a door case, said bottom rail member means including a movable spreader rail;

top rail member means, said top rail member means being located above and slidably connected to said bottom rail member means, for movement in a vertical direction for adjustment of the height of an upper surface of said top rail member means relative to the height of a floor adjacent a door case;

sealing means disposed between said movable spreader rail and said top rail member means; and clamping means, operatively connected to said movable spreader rail, for moving said spreader rail to clamp said sealing means between said movable spreader rail and said top rail member means.

2. The separating device of claim 1, wherein said sealing means comprises a thick buffer strip made of plastic.

3. The separating device of claim 1, wherein said sealing means comprises a thick buffer strip made of wood.

4. The separating device of claim 1, wherein said sealing means comprises a moisture proof seal.

5. The separating device of claim 1, wherein said top rail member means is made of metal.

6. The separating device of claim 1, wherein said top rail member means is made of plastic.

7. The separating device of claim 1, wherein said bottom rail member means comprises a vertical leg, a horizontal leg and said movable spreader rail, said vertical leg having a length greater than said horizontal leg, one end of said vertical leg connected to one end of said horizontal leg, the other end of said horizontal leg connected to form a swivel hinge with said movable spreader rail, said movable spreader rail extending at an angle to said horizontal leg in a direction towards said vertical leg such that said vertical leg, said horizontal leg and said movable spreader rail define a triangular shape, said movable spreader rail having a clamping surface facing said top rail member means, said clamping surface having a toothed profiling; and said top rail member means comprises a downwardly extending attachment portion which is slidably connected to said vertical leg of said bottom rail member means, said top rail member means further comprising a downwardly extending clamping portion having a surface which defines a recess between said downwardly extending attachment portion and said downwardly extending clamping portion, said surface of said downwardly extending clamping portion being parallel to said movable spreader rail in a non-expanded condition and having a toothed profiling, whereby said sealing means is clamped between said toothed profiling of said movable spreader rail of said lower rail member means and said toothed profiling of said downwardly extending clamping portion of said top rail member means.

8. The separating device of claim 7, wherein said bottom rail member means is adapted to be secured to straps mounted on the lower ends of a door case, said vertical leg of said bottom rail member means having holes at locations where said vertical leg is secured to said straps, said holes being elongated in a vertical direction to form oval shaped holes, said vertical leg of said bottom rail means being secured to said straps by screw bolts and nuts, said nuts having diameters larger than the widths of said oval shaped holes.

9. The separating device of claim 7, wherein said bottom rail member means includes horizontal straps, said horizontal straps being attached to the lower end of said vertical leg and extending in a direction opposite to said horizontal leg, said horizontal straps being disposed at distances along said vertical leg approximately one-third of the overall width of a door installed in a door case to which said separating device is attached, said straps having threaded holes for receiving screw bolts which have pointed ends and are threaded through said holes until the pointed ends of said screw bolts contact a surface of an unfinished floor.

10. The separating device of claim 7, wherein said top rail member means further comprises a groove into which an elastic gasket can be inserted, said groove being located on a side of said top rail member means facing a door leaf whereby an elastic gasket inserted into said groove provides a noise and air seal between said separating device and a door leaf.

11. The separating device of claim 7, wherein said top rail member means has first vertical surface which defines an outer surface of said downwardly extending attachment portion, said top rail member means has a second vertical surface spaced from and parallel to said first vertical surface which defines an opposite outer surface of said downwardly extending clamping portion, said downwardly extending clamping portion having an inclined outer surface which abuts said second surface and extends at an angle in a direction away from said outer surface of said downwardly extending attachment portion, said second surface adapted to be disposed such that said second surface is flush with an edge of a door case which has an elastic gasket inserted therein for providing a noise and an air seal between a door leaf and the door case.

12. The separating device of claim 7, wherein said clamping means comprises headless screw bolts which are threaded through holes in said vertical leg of said bottom rail member, one end of said headless screw bolts being in contact with a surface of said movable spreader rail which faces said vertical leg, said movable spreader rail being expanded in a direction towards said top rail member means by tightening said headless screw bolts, the other end of said headless screw bolts extending away from said vertical leg in a direction opposite to said movable spreader rail, and nuts threaded on said other end of said headless screw bolts.

13. The separating device of claim 12, wherein said headless screw bolts are spaced approximately 15 cm apart and are threaded through a top part of said vertical leg of said bottom rail member means.

14. The separating device of claim 12, wherein said one end of said headless screw bolts is pointed, said movable spreader rail further comprises slip-free tongues on said surface of said movable spreader rail facing said vertical leg, said slip-free tongues receiving said pointed ends of said headless screw bolts.

15. The separating device of claim 12, wherein said downwardly extending attachment portion of said top rail member means is flush with an outer surface of said vertical leg of said bottom rail member means, said downwardly extending attachment portion of said top rail member means having U-shaped holes therein for receiving said headless screw bolts, said nuts having diameters larger than the widths of said U-shaped holes whereby said top rail member means can be adjusted vertically relative to said bottom rail member means.

16. The separating device of claim 15, wherein the widths of said U-shaped holes is greater than the diameters of said headless screw bolts for allowing lateral mounting tolerances in mounting said separating device in a door case.

* * * * *